US006321727B1

(12) United States Patent
Reddy et al.

(10) Patent No.: US 6,321,727 B1
(45) Date of Patent: Nov. 27, 2001

(54) LEAK DETECTION FOR A VAPOR HANDLING SYSTEM

(75) Inventors: Sam Raghuma Reddy, West Bloomfield; Gregory Earl Rich, Chesterfield; Gregory Edward Labus, Fenton; Timothy E. Mc Carthy, Grand Blanc, all of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/492,400

(22) Filed: Jan. 27, 2000

(51) Int. Cl.[7] ..... F02M 33/02
(52) U.S. Cl. ..... 123/520
(58) Field of Search ..... 123/520, 516, 123/519, 198 D; 73/118.1, 40

(56) References Cited

U.S. PATENT DOCUMENTS 5,263,462 11/1993 Reddy ..... 123/520
5,275,144 * 1/1994 Gross ..... 123/198
5,437,257 * 8/1995 Giacomazzi et al. ..... 123/520
5,494,021 * 2/1996 Yoneyama ..... 123/516
5,635,630 * 6/1997 Dawson et al. ..... 73/40.5
6,073,487 * 6/2000 Dawson ..... 73/118.1
6,089,081 * 7/2000 Cook et al. ..... 73/118.1

* cited by examiner

*Primary Examiner*—Henry C. Yuen
*Assistant Examiner*—Mahmoud Gimie
(74) *Attorney, Agent, or Firm*—George A. Grove; Jeffrey A. Sedlar

(57) ABSTRACT

The engine or powertrain control module of a vehicle remains electrically powered after the engine is stopped and is used to assess whether there is a leak in the evaporative emissions control system. Fuel tank temperature and pressure data, as well as fuel level data, is analyzed over a brief period of time by module and, if ambient conditions are suitable, the vent on the fuel adsorption canister is closed by signal from the module. The system is thus sealed and the module then analyzes the system pressure changes over a second brief period as the fuel cools by heat loss to detect the vacuum that will occur if the system has no leak.

2 Claims, 3 Drawing Sheets

LEAK DETECTION FOR A VAPOR HANDLING SYSTEM

TECHNICAL FIELD

This invention pertains to evaporative emission control systems. More specifically, it pertains to a method for detecting leaks in such fuel vapor handling systems.

BACKGROUND OF THE INVENTION

Fuel evaporative emission control systems have been in use on automotive vehicles for over 30 years. The gasoline fuel used in many internal combustion engines is quite volatile. The fuel typically consists of a hydrocarbon mixture ranging from high volatility butane (C-4) to lower volatility C-8 to C-10 hydrocarbons. When a vehicle is parked in a warm environment during the daytime heating (i.e., diurnal heating), the temperature in the fuel tank increases. The vapor pressure of the heated gasoline increases and fuel vapor will flow from any opening in the fuel tank. Normally, to prevent vapor loss into the atmosphere, the tank is vented through a conduit to a canister containing suitable fuel adsorbent material. High surface area activated carbon granules are widely used to temporarily adsorb the fuel vapor.

The fuel vapor enters the canister through a top inlet of the canister and into the carbon granule mass. The vapor diffuses downwardly under its own pressure and gravity into the volume of carbon granules where it is adsorbed in temporary storage. The total volume of adsorbent is specified so as to be suitable to retain a quantity of fuel vapor expected to evaporate from the fuel tank during normal or representative usage of the vehicle.

The canister is molded of a thermoplastic material and shaped so that ambient air can be drawn through the carbon granule bed during engine operation to purge adsorbed fuel from the surfaces of the carbon particles and carry the removed fuel into the air induction system of the vehicle. Typically, a partition is formed in the canister to lengthen the flow of vapor and air through the volume of carbon particles. Thus, the fuel vapor enters at one end, the vapor inlet, of the flow path and escapes at the opposite end, the vent outlet, if the quantity of fuel exceeds the adsorption capacity of the carbon volume. Air, induced to flow through the carbon under engine intake vacuum, enters the canister at the vapor vent end of the flow path. The air traverses the full length of the flow path and exits the canister with desorbed, i.e., purged, fuel through a purge outlet at the vapor inlet end of the carbon volume.

The described emission control system obviously works in a repeating cyclical mode. When the engine is not running, fuel vapor generated by diurnal heating, the previous return of hot fuel or the like, flows to the canister and is adsorbed up to the capacity of the adsorbent volume. The vehicle may remain idle for several days and fuel vapor will accumulate in the canister. The initial loading will be at the inlet end of the adsorbent volume, but the fuel gradually becomes distributed along the entire adsorbent bed pathway. When the vehicle engine is started and can accommodate a fuel-air mixture, a purge valve is opened and purge air is drawn through the adsorbent volume. Purging can continue as long as the engine is running and the air can cause the removal of a substantial portion of the stored fuel vapor.

Environmental regulators are proposing lower limits on the amount of fuel vapor that can escape the evaporative emission system during a prescribed test of the system in a closed space. For example, the California Air Resources Board (CARB) has proposed "zero" and "near zero" evaporative emission standards for automotive vehicles for year 2004. The proposed standards require that there cannot be any leaks in the vapor emission control system. Also, CARB onboard diagnostics regulations require that the evaporative emission control system diagnostics should be able to detect a 0.02 inch diameter leak in the system.

Recently, vehicles have incorporated diagnostic systems to detect problems or malfunctions in the operation of vehicle operating and emission control systems including the evaporative emission control system. However, in the case of the fuel vapor handling systems, there has been no practical on-board diagnostic procedure capable of detecting small leaks, of the order of 0.02 inch, in the evaporative emission control system of some vehicles, especially those equipped with vacuum compliant plastic fuel tanks. It is desirable to have such a diagnostic procedure that can be automatically performed by the vehicle computer control system and suitable complementary sensors to detect such small leaks and provide a notice of the leak to the vehicle operator.

SUMMARY OF THE INVENTION

This invention provides a method of detecting small leaks, e.g., about 0.02 inches, that release fuel vapor from the fuel system of an automotive vehicle. The method utilizes an on-board computer, such as the engine or powertrain control module, to evaluate fuel tank pressure and temperature signals to consider whether a diagnostic test can be conducted and, when appropriate, whether there is a leak in the fuel tank, fuel vapor vent line, adsorption canister or other parts of the system.

The method is practiced in connection with a fuel vapor control system that includes a fuel tank with fuel level, temperature and pressure sensors; a vapor vent line from the tank to a carbon granule filled vapor adsorption canister; and a vapor purge valve and a vapor vent/air inlet valve for the canister. Further, the invention is practiced by continuing to operate the engine or powertrain control computer for a brief time after the engine has been shut off.

A basic aspect of the method is to temporarily seal the vapor control system at an appropriate time after an engine shut-off and then to quickly determine whether the pressure in the fuel tank drops below atmospheric pressure when the fuel in the tank cools and its vapor pressure decreases markedly. The sensing of a vacuum indicates that no significant leak exists while a failure to sense a suitable vacuum indicates the presence of a leak. However, critical features of the invention also include determining when ambient conditions are such that a suitable leak test can be performed. In principle, a leak test could be conducted each time the engine is turned off. But, as a practical matter, there is not always an appropriate amount of fuel in the tank or ambient conditions do not always permit timely cooling of the fuel within a suitable time, and the procedure is aborted to conserve battery energy.

The fuel tank temperature and pressure data and time data are accumulated for just a suitable brief time and stored in the engine control module database. The computer is than preferably shut down and analysis of the data and the provision of a leak signal if required undertaken after the engine is later started. It is intended that the subject leak test method be conducted or aborted within a period of minutes up to about an hour of engine shut-off so as to accomplish the object of the invention without prolonged operation of the engine control module when the engine is not running.

The size of a perceived leak can be estimated in the control module utilizing data such as the observed and recorded temperature decrease, pressure decrease and vapor volume during a leak test. The reference basis of the analysis may be predetermined leak data stored in a look-up table in the module or a predetermined mathematical model for leak estimation stored in the module.

Other objects and advantages of the invention will become more apparent from a detailed description of the invention which follows. Reference will be had to the drawings which are described in the following section.

DESCRIPTION OF A PREFERRED EMBODIMENT

Example of Evaporative Emission Control System

Figure 1:
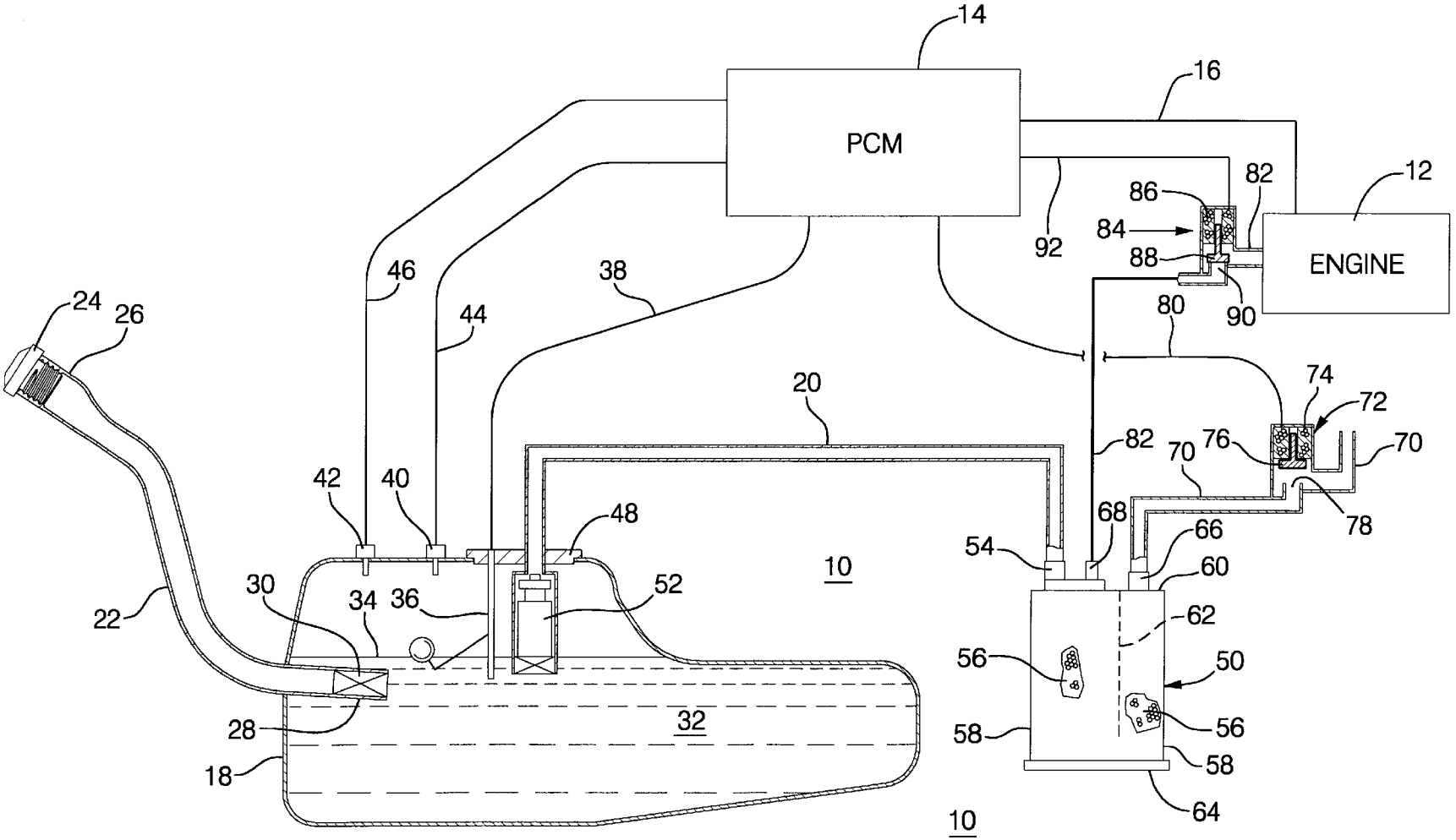
FIG. 1 is a schematic view, partly in cross section, of a vehicle fuel vapor control system including a fuel tank, fuel vapor line and a fuel vapor adsorbing canister with a purge line and solenoid-actuated valve and a vent line and solenoid-actuated valve.

A typical evaporative fuel emissions control system 10 for an automotive vehicle is illustrated in FIG. 1. The illustration is schematic and the components are not drawn to scale.

The system comprises an engine schematically indicated at block 12. However, the engine would typically be a multi-cylinder, gasoline-powered, internal combustion engine. The operation of a modern fuel efficient, low exhaust and evaporative emissions engine is controlled using a suitable programmed digital microprocessor or computer, indicated at block 14. The microprocessor is part of a control module that controls the operation of at least the engine and its emission controls (an engine control module, ECM) or the engine, emission controls and transmission (a powertrain control module, PCM). Such control modules in various similar forms are used on millions of cars, sport utility vehicles, trucks, and the like, today.

When the engine is started, the powertrain control module, which is powered by the vehicle battery (not shown) starts to receive signals from many sensors on the engine, transmission and emission control devices. Line 16 from the engine 12 to control module 14 schematically depicts the flow of such signals from the various sensors on the engine. During engine operation, gasoline is delivered from a fuel tank 18 by a fuel pump (not shown, but often located in the fuel tank) through a fuel line (not shown) to a fuel rail and fuel injectors that supply fuel to each cylinder of the engine or to ports that supply groups of cylinders. The timing of the operation of the fuel injectors and the amount of fuel injected per cylinder injection event is managed by the control module 14. The subject emission control purge system is operated in harmony with engine operation to avoid upsetting the air-to-fuel ratio in the engine with a secondary flow of fuel containing air.

Since gasoline and other fuels are quite volatile, fuel tank 18 is closed except for a vent line 20. Tank 18 is often made of blow molded, high density polyethylene provided with a suitable interior gasoline impermeable layer(s). The tank 18 is provided with fill tube 22 with a gas cap 24 closing the gas fill end 26. The outlet end 28 of fill tube 22 is inside tank 18 and is provided with a one-way valve 30 to prevent liquid fuel from splashing out the fill tube 22.

A volume of gasoline 32 is indicated with upper surface 34. A float-type fuel level indicator 36 provides a fuel level signal through line 38 to the control module 14. Fuel tank pressure sensor 40 and temperature sensor 42 provide their respective data through signal transmitting lines 44 and 46, respectively, to control module 14. The sensors are used in this invention for diagnostic purposes. Sometimes both functions may be combined in a single sensor.

Fuel tank 18 is provided with a vent line 20 that leads through seal 48 from the top of the tank to a fuel vapor adsorption canister 50. Float valve 52 within the tank 18 prevents liquid gasoline from entering vapor vent line 20. During heating of the fuel in the tank by liquid fuel returned from the hot engine (through fuel return line, not shown) or by ambient heating, hydrocarbon fuel vapor is generated from the gasoline. Vapor mixed with air (often moisture containing air) flows under the vapor pressure through vent line 20 to the vapor inlet of canister 50. The vapor enters canister vapor inlet 54 and diffuses into adsorptive material 56.

Canister 50 is typically molded of a suitable thermoplastic polymer such as nylon. In this embodiment, canister 50 comprises four side walls, defining an internal volume of rectangular cross section (two side walls 58 shown), with an integral top 60 and a vertical internal partition 62 that extends from top 60 and the front and rear sides. Canister 50 includes a bottom closure 64 that is attached to the side walls. As shown, partition 62 extends toward but short of the bottom closure 64. At the top of canister 50 is a vapor vent opening 66 that also serves as an inlet for the flow of air during the purging of adsorbed fuel vapor from the adsorbent material 56. Also formed in the top 60 of the canister 50 is a purge outlet 68 through which a stream of purge air carrying purged fuel vapor can exit the canister. It is seen that the construction of canister 50 extends the flow path of vapor from vapor inlet 54 to vapor vent 66 because of the partition 62 and closed bottom 66.

Connected to vent opening 66 is a vapor vent/air inlet line 70 and solenoid-actuated vent valve 72. Vent valve 72 is normally open as shown, but upon actuation of battery-powered solenoid 74, stopper 76 is moved to cover vent opening 78. Solenoid 74 is actuated upon command of control module 14 through signal lead 80. The vent valve 72 is usually only closed for diagnostic purposes such as in the practice of this invention.

Purge outlet 68 is connected by purge line 82 through solenoid-actuated purge valve 84 to the engine 12. Purge valve 84 includes a battery-powered solenoid 86 and stopper 88 to close purge opening 90. Purge valve 84 is closed at engine-off and is opened only by command of control module 14 through signal lead 92 when the engine 12 is running and can accommodate the secondary stream of fuel-laden air stream drawn through canister 50.

As stated above, during suitable periods of engine-on operation, when the engine can accommodate purged fuel vapor in its air inlet, both vent valve 72 and purge valve 84 are open. Air enters vapor vent/air inlet line 70 and flows through the volume of carbon granules on both the right side and left side of partition 62 and exits through canister purge outlet 68. The flow of air carries hydrocarbon vapor removed from the surfaces of carbon granules 56 through purge line 82 to engine 12. Depending upon ambient conditions, fuel vapor may also be flowing from fuel tank 18 through vent line 20 and vent inlet 54 of canister 50. Since the vapor inlet 54 is spaced from purge outlet 68, the vapor can enter the canister but will be removed by the counter flow of air. Thus, during engine operation much of the fuel vapor temporarily stored in canister 50 is removed to provide adsorption capacity for vapor generated during the next engine-off period.

Also during the engine-on period, the control module 14 can run diagnostic tests of many systems of the vehicle. However, it has not been practical to test for small leaks in the evaporative emissions control system during engine operation. In accordance with this invention, provision is made from time to time as specified to continue operation of control module 14 for a limited period after engine shut off to test for small leaks in the evaporative control system.

Example of the Practice of the Leak Detection Method

The subject method relies upon the presence of suitable conditions in a sealed fuel tank vent line and adsorption canister that will enable the formation of a vacuum in the fuel tank as the contents of the tank cool down following an engine shut off. In other words, if the test conditions are appropriate during an engine-off occurrence, a natural vacuum develops upon ambient cooling of the fuel in the sealed fuel system which indicates that there is no leak. On the other hand, if the conditions are otherwise suitable for the formation of an engine-off natural vacuum and a suitable pressure drop does not occur, the presence of a leak is inferred. Furthermore, it is possible to estimate the size of a leak by utilizing the engine control module to record and subsequently analyze data concerning tank temperature drop, pressure drop and vapor volume. A notice is then given to the operator of the vehicle so that the vapor handling system can be repaired.

While much of the subject engine-off natural vacuum evaporative diagnostic test is conducted while the engine is shut off, but with the control module running, certain tests or queries can be run by the control module microprocessor while the engine is running to determine whether conditions suitably enable the further conduct of the diagnostic test. For example, the state of battery charge and the fuel level are regularly checked by the control module during engine operation. The purpose of the engine-off natural vacuum (EONV) test is, of course, to detect a real leak and to avoid giving a false leak notice to the operator of the vehicle. Accordingly, certain enable criteria are evaluated before the EONV test is undertaken.

Figure 2:
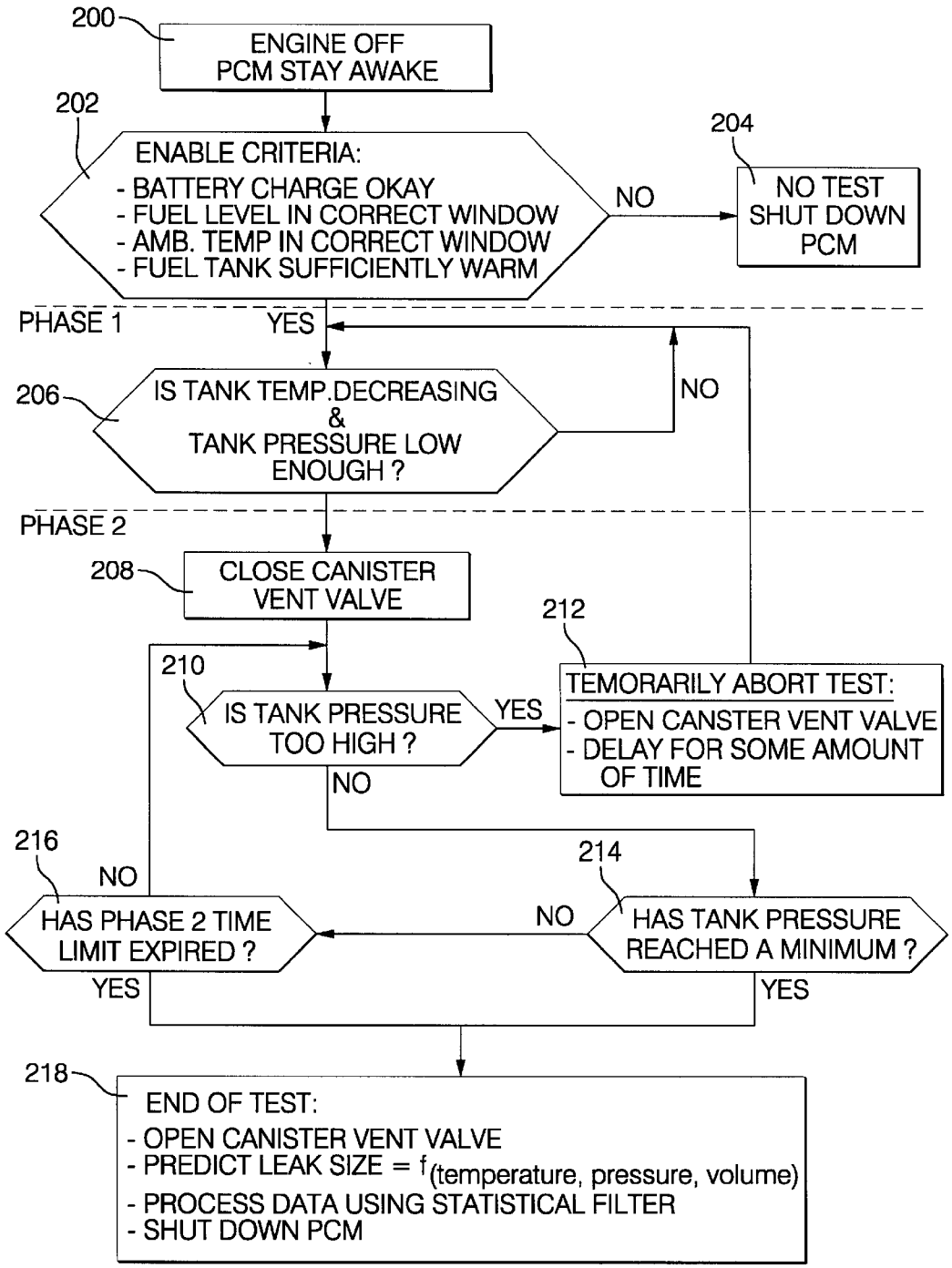
FIG. 2 is a process flow diagram illustrating a preferred embodiment of the invention.

FIG. 2 is a flow diagram illustrating a practice of the invention. Block 200 depicts the status of the vehicle engine 12 (referring again to FIG. 1) and control module 14 at the beginning of the test method of this invention. As indicated in block 200, the engine is off, and the powertrain control module or other utilized microprocessor remains powered and operative. The process then proceeds to query block 202 to determine whether conditions are suitable for the EONV test.

In accordance with a preferred embodiment, certain minimal test enable criteria must exist before proceeding with the EONV leak test. The state of battery charge must be suitable to maintain operation of the control module 14 and to activate the vent solenoid 74 so as to close the canister vapor vent/air intake valve 72 when required during the test.

It is also preferred that the fuel level in the fuel tank be between about 15% and 85% of the tank capacity. This fill level leaves a suitable vapor volume that is productive of data particularly useful for the diagnostic test. Moreover, if there is a sharp increase in the fuel tank pressure likely indicating a refueling event, the test method is not conducted during such an event.

The ambient temperature is also measured, usually by a sensor in the engine compartment not shown in FIG. 1. It is preferred that the ambient temperature be above about 40° F. Lower temperatures tend to produce relatively low fuel vapor pressures and correspondingly low changes in pressure so as to make EONV testing less reliable. Further, fuel line freezing can cause a misdiagnosis. It is also preferable that the temperature in the fuel tank (indicated by sensor 42) be at least about 5° F. above the ambient temperature so that the fuel will experience the necessary cooling during the test.

It is also preferred that the normal ongoing diagnostic tests of the powertrain control module or the like have turned up no other vehicle operating parameters or malfunctions that would affect the conduct of the subject leak test. Thus, while many of the requisite enabling criteria set forth in query block 202 are conducted during engine-off status, it is obvious that some data may be obtained when the engine is running and stored in the PCM 14.

In the event that any specified criteria are not satisfied in the block 202 query (i.e., the answer is no), the process will not proceed to conduct the EONV test on the present engine shut down cycle. Instead, the powertrain control module 14 is turned off (block 204), the vent valve 72 remains open and the test aborted.

In the event that all specified enable criteria are satisfied in block 202 (the answer is yes), the method proceeds to query block 206. Block 206 represents Phase 1 of the method, a waiting phase. In this step, the microprocessor of module 14 casually samples the temperature sensor 42 and pressure sensor 40 inputs waiting for suitable changes of tank temperature and tank pressure for proceeding with the leak test. Depending upon ambient conditions the control module may be permitted to cycle, e.g., up to 60 minutes as governed by its clock. A typical period is less than five minutes. Rather than permit a longer Phase 1 period, it may be preferred to stop the test and await the next engine-off occurrence for more favorable ambient conditions. The cycling of the control module continues until a steady decrease in fuel tank temperature is noted. The canister vent valve 72 remains open during Phase 1.

Tank temperature is systematically sampled, for example, every 10 seconds or so, to determine when the contents of the tank reach a maximum temperature and start to decrease. Similarly, the tank pressure sensor is also queried at intervals of, for example, 50 to 100 milliseconds to wait until the tank pressure reaches a level, for example, about 0.5 inch of water or less above atmospheric pressure. The faster pressure sampling rate is required in order to detect fuel slosh or a fuel tank refueling event. These conditions provide suitable data in accordance with this invention to determine the presence and size of even a small leak in the evaporative control system. When such conditions are noted in PCM 14 (the answer in query box 206 is yes), the process proceeds to block 208 and Phase 2.

The microprocessor now (block 208) issues a signal to direct battery electrical power to be sent to the vent valve solenoid 74 and canister vent valve 72 is now closed. Since purge valve 84 is shut, the closure of canister vent valve 72 seals the system comprising the fuel tank 18, vent line 20 and canister 50 provided there is no leak. The purge valve 84 is normally shut, and it must be shut in order to comply with the enabling criteria for this test. Having closed the canister vent valve, the process now proceeds to query block 210.

Phase 2 also involves a period in which the control module 14 gathers fuel tank temperature and pressure data over a controlled period of time. Experience in the United States has indicated that a suitable Phase 2 period may be five to thirty minutes, with fifteen minutes typical. The control module microprocessor and tank sensors are powered during this time.

Sometimes closure of the canister vent valve in block 208 will result in a temporary increase in fuel tank pressure. Thus, in query block 210, the PCM 14 checks the tank vapor pressure to determine whether the pressure is still of the order of 0.5 inch of water or less. If the pressure has increased to a value that is considered too high for commencement of the test (the answer is yes), the process proceeds to block 212. The test is temporarily aborted, the canister vent valve 72 is opened, and the process enters a delay to allow the pressure in the system to continue to fall with falling temperature. If the process reaches block 212, it is seen that the process then recycles back to query block 206 for the above-described sequence of operations.

If the answer in query block 210 is no, the process commences a cycle around query blocks 210, 214 and 216. Tank pressure at the beginning of the cycle is stored and the pressure is periodically monitored (e.g., at 50 to 100 millisecond intervals) to seek a continuing low pressure value (high vacuum value) during the time allotted for the Phase 2 portion of the method. The fuel tank temperature sensor is sampled once at entry to block 208 and again just prior to exiting the cycle around query blocks 210, 214 and 216 and entry to block 218. A predetermined time limit for Phase 2, as illustrated above, is imposed in query box 216 to avoid excessive drain on the battery. Once it is determined that the tank pressure has reached a minimum or that the Phase 2 time limit has expired, the process proceeds with the recorded pressure and temperature data to block 218 which constitutes the last step of the test.

Upon entry to block 218, the canister vent valve is opened and the data that has been acquired, if sufficient, is used to calculate whether or not there is a leak in the system. Assuming that the temperature and pressure have fallen by suitable amounts in combination, the analysis will find that there is no leak. This analysis may be undertaken, immediately before module power down and a later engine restart, or the data is simply stored in the powertrain control module until the engine is again started.

Throughout the practice of this method, of course, the microprocessor must remain powered as well as the canister vent valve solenoid, and the fuel tank pressure sensor and vapor temperature sensors must remain functioning and powered.

In one embodiment the analysis may involve a determination by the control module that the fuel vapor control system has cooled and experienced and maintained a vacuum for a few minutes. This observation would be interpreted to indicate that there is no significant leak in the system as of the present test. Conversely, the observation of a persistent positive pressure despite a significant temperature drop would be interpreted as indicating a significant leak. The control module would then initiate a notice to the vehicle operator upon engine start-up. A blinking light or other message on the instrument panel would alert the operator to have the evaporative emissions control system checked and repaired.

In a more sophisticated embodiment, the microprocessor in the control module would subject the accumulated temperature and pressure data, the elapsed time and the fuel level data to a numerical analysis to provide more extensive information concerning a leak. The analysis could estimate the size of the leak. Once the control module is prompted to analyze the temperature and temperature data accumulated through Phase 2, the calculation would require only a millisecond or so.

It is found that the presence of a leak and a suitable estimate of the size of a leak can be determined as a function of the pressure and temperature at the beginning of Phase 2 ($P_1$, $T_1$), the pressure and temperature at the end of Phase 2 ($P_2$, $T_2$), the vapor volumes at the beginning and end of Phase 2 ($V_1$, $V_2$) and the Reid vapor pressure of the fuel.

Thus, estimated leak size=f($P_1$, $T_1$, $P_2$, $T_2$, $V_1$, $V_2$ and RVP).

$V_1$ is measured using the fuel level input and $V_2$ is calculated from $V_1$ using a predetermined allowance for the deflection of the fuel tank depending on the value of $V_2$. For a first approximation, RVP may be estimated by reference to ambient temperature. For example, if the ambient temperature is about 80° F., a RVP of 7–9 psi may be assumed. At higher ambient temperatures, a RVP of 7 psi is assumed. At 40° F., a RVP of about 11 psi is assumed, and at 0° F., a RVP of about 14 psi may be assumed. A more sophisticated model for estimating Reid vapor pressure may be used especially if RVP data is to be otherwise used in the engine control module to manage air-to-fuel ratio in engine operation.

Data for developing a general empirical relationship for a specific emission control system may be obtained by conducting tests with arbitrarily created leaks at a varying ambient conditions and with a range of fuels. The constants for the algebraic expression involving, e.g., the above parameters can be determined by means of a regression analysis of the data. The data can be modeled using a suitable multivariable nonlinear regression analysis technique such as that proposed by Levenberg and Marquardt (see "Numerical Recipes in Fortran", Cambridge University Press, 1992, Chapter 15, Modeling of Data). Of course, the testing and modeling is done off line and the thus-determined constants or an equivalent look-up table is stored in the control module for use in the analysis of the data produced in a leak test of this invention. Providing that such off line tests have included suitable input data, additional parameters such as the aspect ratio of the leak and the location (plumbing, canister, fuel cap, etc.) of the leak may be estimated.

Figure 3:
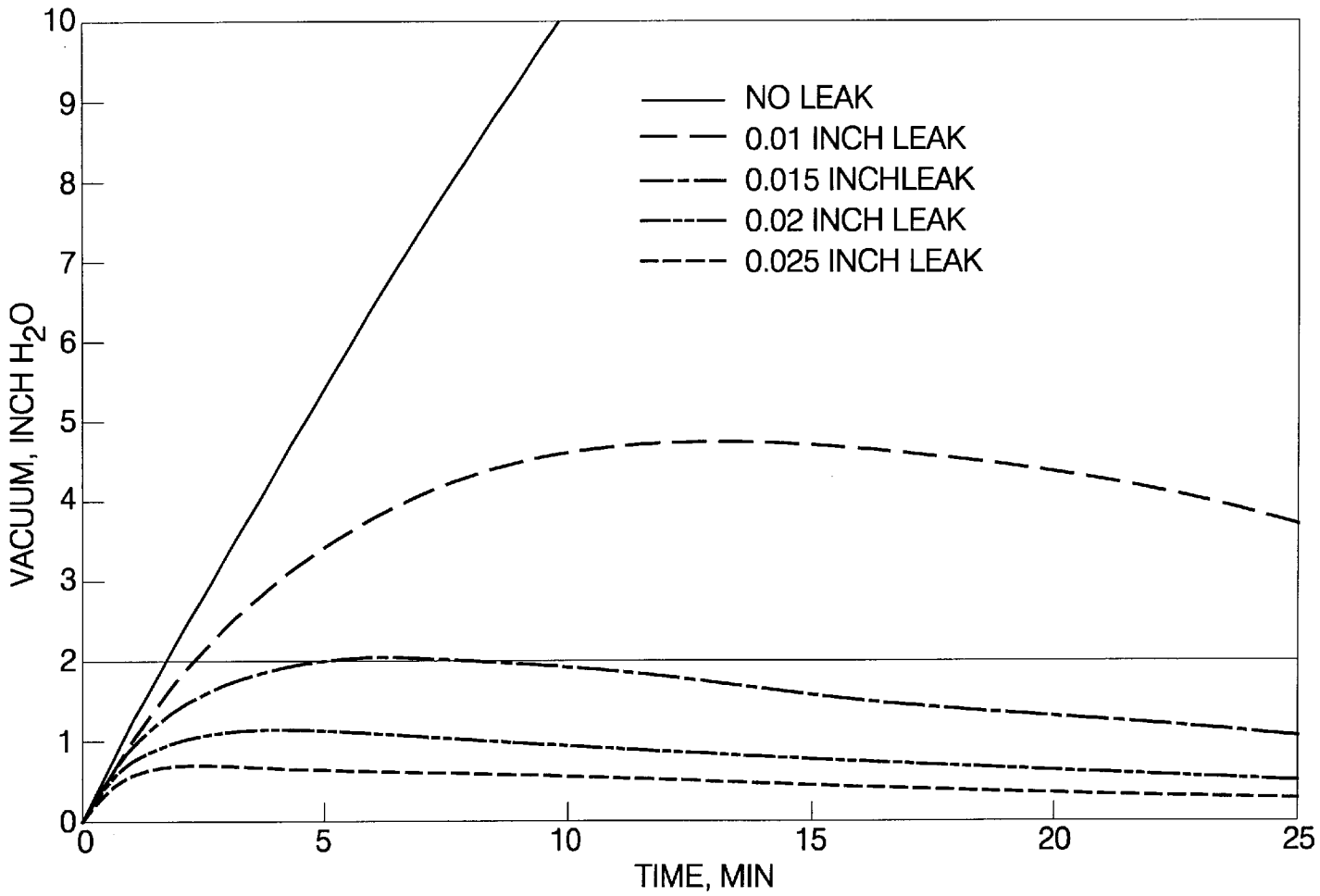
FIG. 3 is a graph of fuel tank vacuum (in inches of water) predicted for a range of evaporative emission leak sizes in a specified fuel vapor control system.

FIG. 3 is a plot of a model predicted, Phase 2 results for a fuel vapor control system including an 18 gallon fuel tank filled to 40% of capacity with RVP 9 fuel. The ambient temperature was 75° F. and $T_1$ was 85° F. In the environment of this test, it is seen that with no leak present the pressure in the tank steadily fell to a vacuum of 10 inches of water in less than 10 minutes from the start of Phase 2. Vacuum readings in inches of water over test times up to 25 minutes are shown for leaks of 0.01 inch, 0.015 inch, 0.02 inch and 0.025 inch diameter, respectively. In this case, if the EONV was below two inches of water, it would be concluded that the system had a leak and that its size is greater than 0.015 inch diameter.

It is typically found that the FIG. 3 curves shift upwardly for higher vapor space volumes and higher RVP fuels. However, leaks of 0.02 inch and greater could still be detected. With lower RVP fuels and lower vapor spaces, even smaller leaks were detectable.

As stated, the above type of evaluation can be done during engine-off operation or at the beginning of the next engine-on period.

While this invention has been described in terms of some specific embodiments, it will be appreciated that other forms can readily be adapted by one skilled in the art. Accordingly, the scope of this invention is to be considered limited only by the following claims.

What is claimed is:

1. A method of detecting a leak in a fuel vapor emission control system of an internal combustion engine driven vehicle, said fuel vapor system comprising a fuel tank including a fuel vapor temperature sensor and a tank pressure sensor; a vapor vent line leading from said tank to a fuel vapor adsorption canister, said canister comprising a vapor vent/air inlet line including a vent valve and a vapor purge line including a purge valve, said vent and purge valves being operated under the control of an emission control system computer module, said method to be executed by operation of said computer and comprising the steps of, closing said purge valve, if necessary, and said vent valve following engine shut-off, sensing said fuel vapor temperature and tank pressure during a period of time when said engine is shut off and said fuel vapor temperature is decreasing, recording said pressure and temperature during said period, opening said vent valve, and providing an indication of no detectable system leak if said pressure decreases below atmospheric pressure, or recording an indication of system leak if said pressure does not fall below atmospheric pressure, during said time period, wherein prior to closing said canister vent valve, determining that the fuel content of the fuel tank is in the range of about 15% to 85% of the capacity of the tank, and if the fuel content is not in said range, shutting down said computer to abort the leak detection test.

2. A method of detecting a leak in a fuel vapor emission control system of an internal combustion engine driven vehicle, said fuel vapor system comprising a fuel tank including a fuel vapor temperature sensor and a tank pressure sensor; a vapor vent line leading from said tank to a fuel vapor adsorption canister, said canister comprising a vapor vent/air inlet line including a vent valve and a vapor purge line including a purge valve, said vent and purge valves being operated under the control of an emission control system computer module, said method to be executed by operation of said computer and comprising the steps of, closing said purge valve, if necessary, and said vent valve following engine shut-off, sensing said fuel vapor temperature and tank pressure during a period of time when said engine is shut off and said fuel vapor temperature is decreasing, recording said pressure and temperature during said period, opening said vent valve, and providing an indication of no detectable system leak if said pressure decreases below atmospheric pressure, or recording an indication of system leak if said pressure does not fall below atmospheric pressure, during said time period, wherein prior to closing said canister vent valve, determining that the ambient temperature is above about 40° F., and if the ambient temperature is not above said temperature, shutting down said computer to abort the leak detection test.

* * * * *